US005640726A

United States Patent [19]

Fichner-Rathus

[11] Patent Number: 5,640,726

[45] Date of Patent: Jun. 24, 1997

[54] SAFETY RAIL FOR SLEEPING BEDS

[76] Inventor: Lois Fichner-Rathus, 31 Knollwood Rd., Short Hills, N.J. 07078

[21] Appl. No.: 507,073

[22] Filed: Jun. 26, 1995

[51] Int. Cl.[6] ..... A47C 21/08

[52] U.S. Cl. ..... 5/426; 5/904; 5/925

[58] Field of Search ..... 5/426, 425, 427–430, 5/663, 925, 904

[56] References Cited

U.S. PATENT DOCUMENTS

| | | | |
|---|---|---|---|
| 2,611,909 | 9/1952 | Dillon et al. | 5/426 |
| 2,751,608 | 6/1956 | Lucas | 5/426 |
| 3,290,701 | 12/1966 | Luff | 5/426 |
| 3,474,473 | 10/1969 | Hannaberg | 5/426 |
| 3,616,469 | 11/1971 | Indeski | 5/426 |
| 4,178,645 | 12/1979 | Cosme | 5/426 |
| 4,183,015 | 1/1980 | Drew et al. | 5/425 |
| 4,833,743 | 5/1989 | Howell et al. | 5/426 |
| 5,191,663 | 3/1993 | Molder et al. | 5/425 |
| 5,463,784 | 11/1995 | Alpern | 5/426 |

FOREIGN PATENT DOCUMENTS

| | | | |
|---|---|---|---|
| 2070921 | 9/1981 | United Kingdom | 5/426 |
| 2225716 | 6/1990 | United Kingdom | 5/426 |

*Primary Examiner*—Alexander Grosz
*Attorney, Agent, or Firm*—Ward & Olivo

[57] ABSTRACT

This invention relates to sleeping beds, and in particular, a safety accessory for attachment to a sleeping bed for preventing the occupant from falling out. The invention provides for a guard rail that can be affixed to a bed, where the guard rail is held in place by a member that both crosses under the sleeping surface, and additionally, protrudes out of the other side of the bed, to make contact with the other side of the bed.

13 Claims, 4 Drawing Sheets

FIG. 3
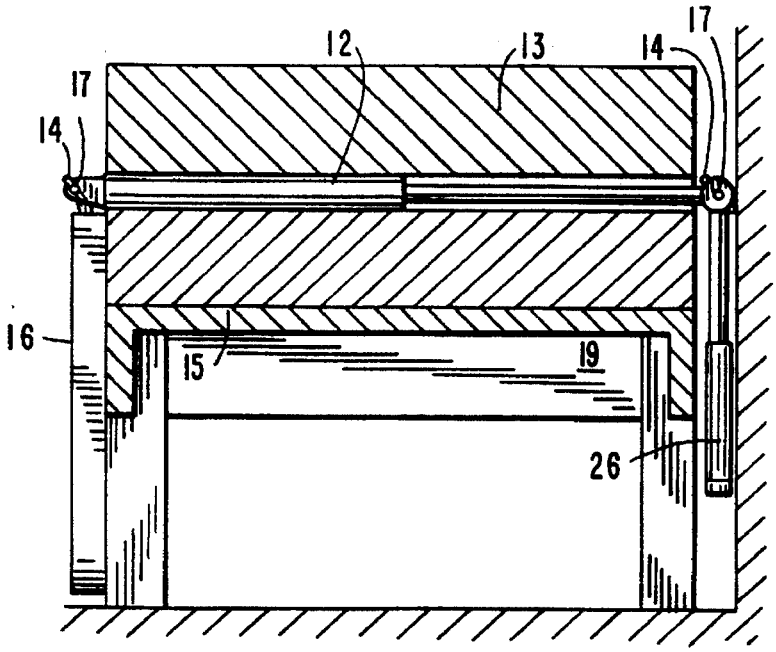
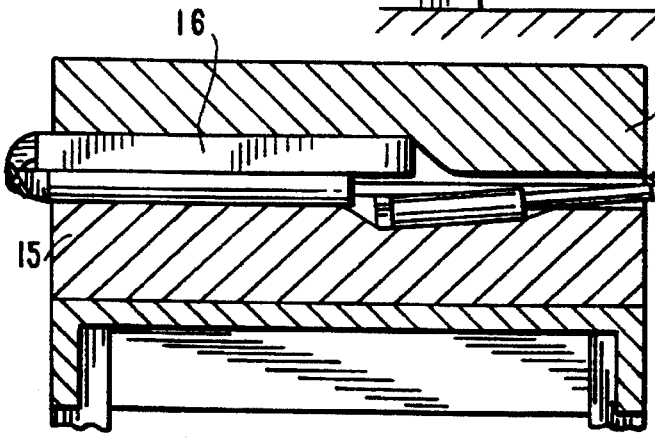
FIG. 4
FIG. 5
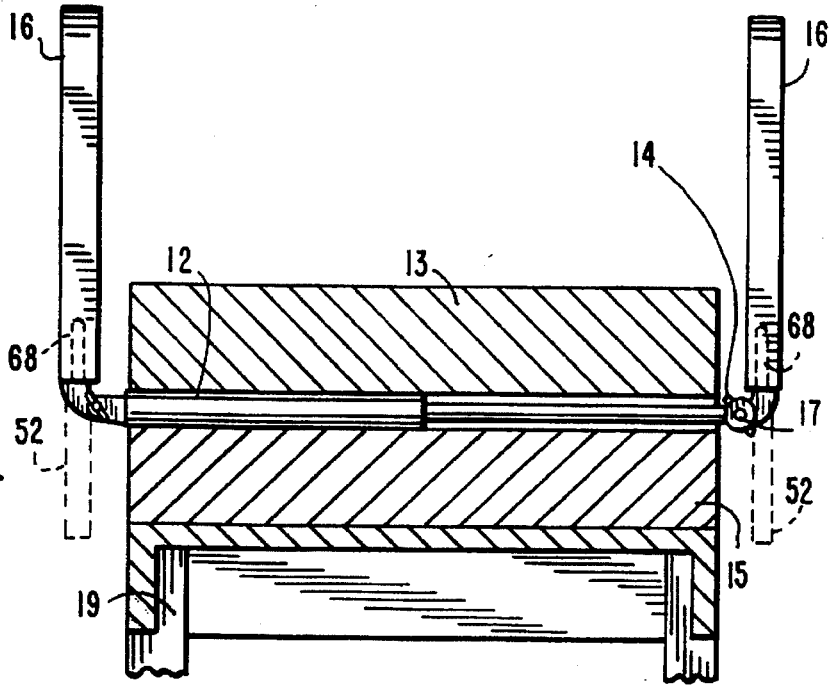

FIG.6
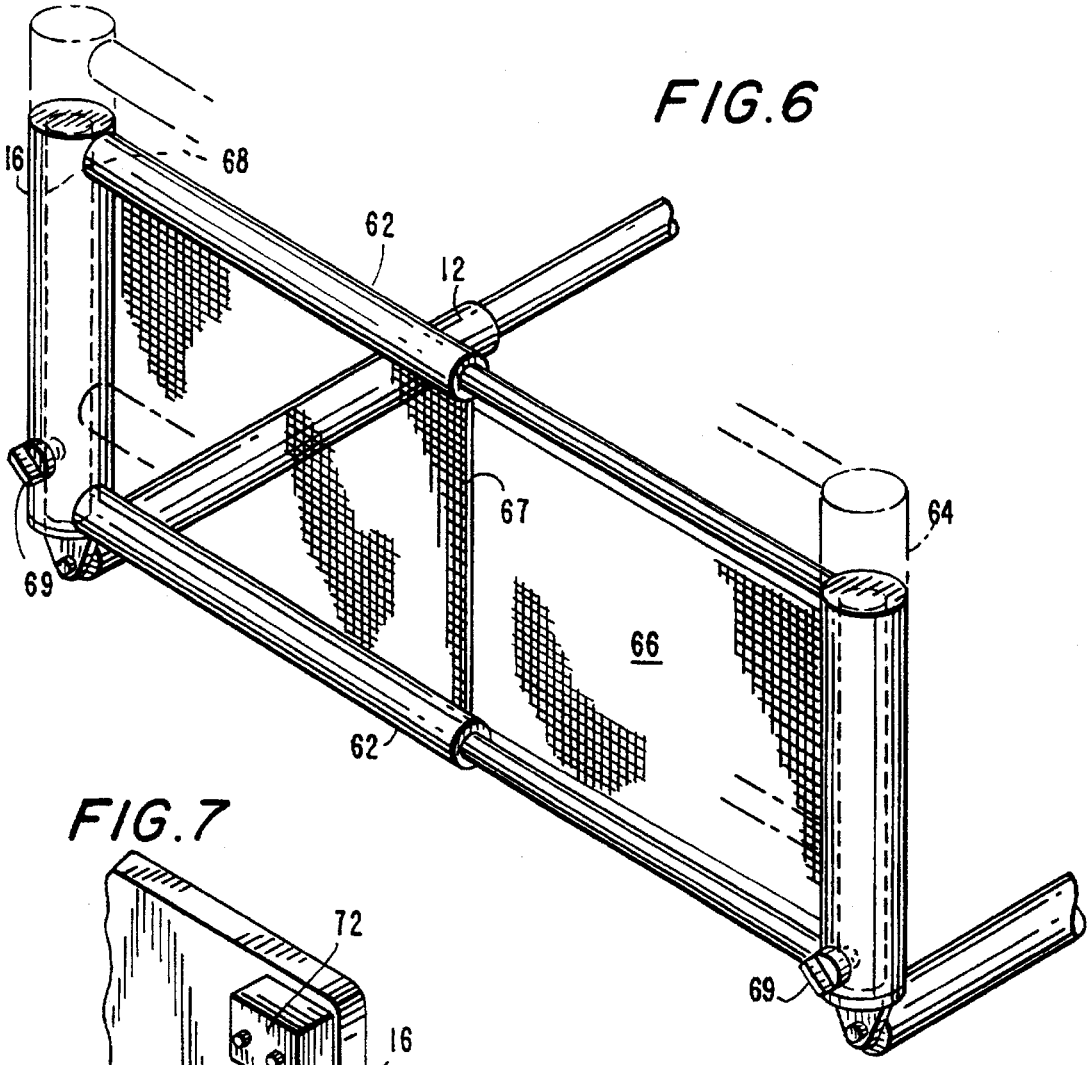
FIG.7
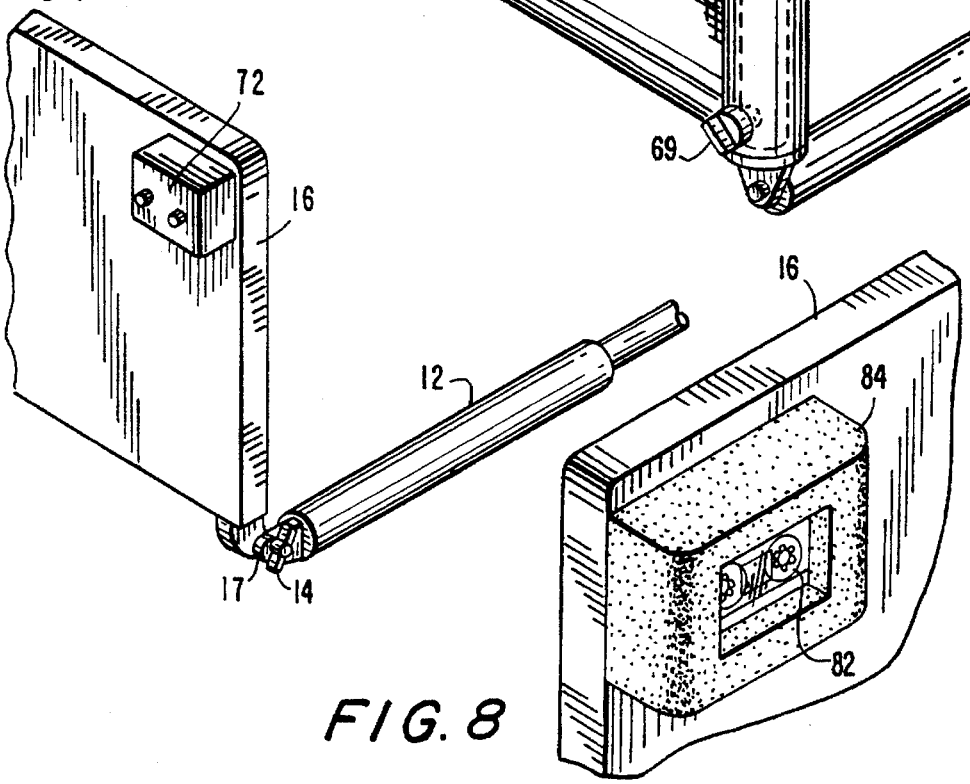
FIG.8

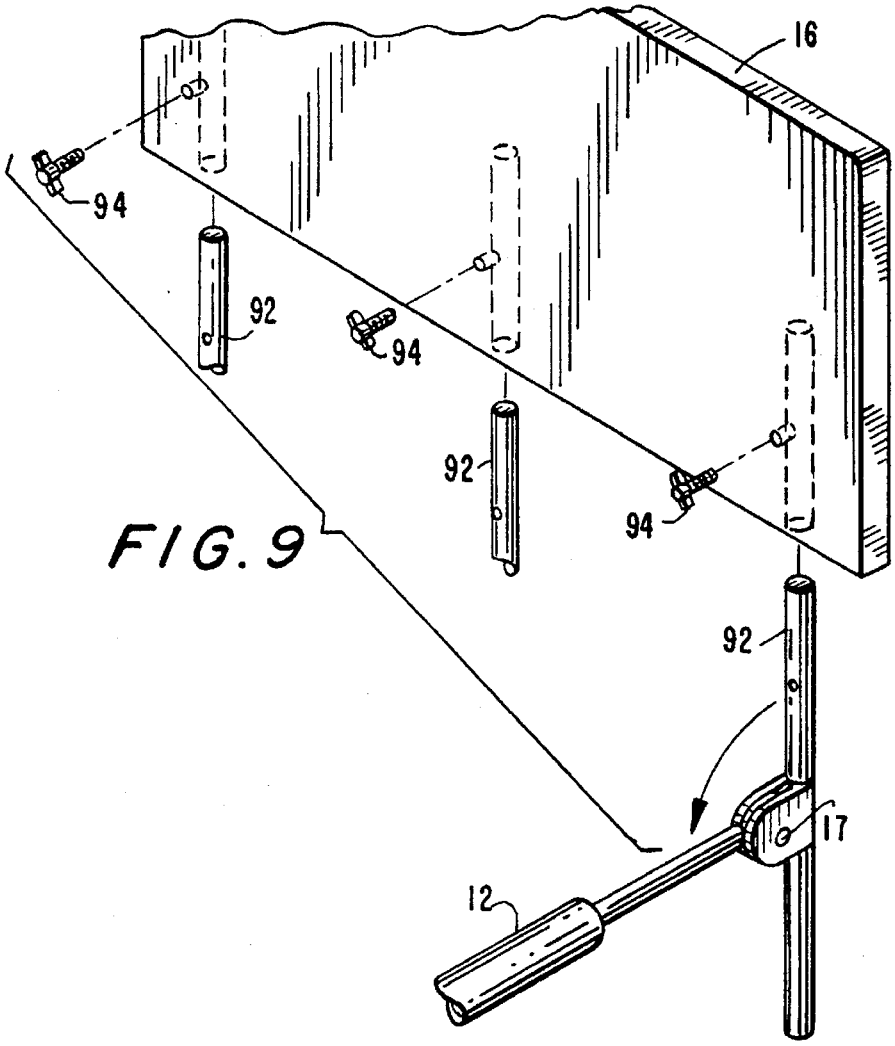
FIG. 9
FIG. 10
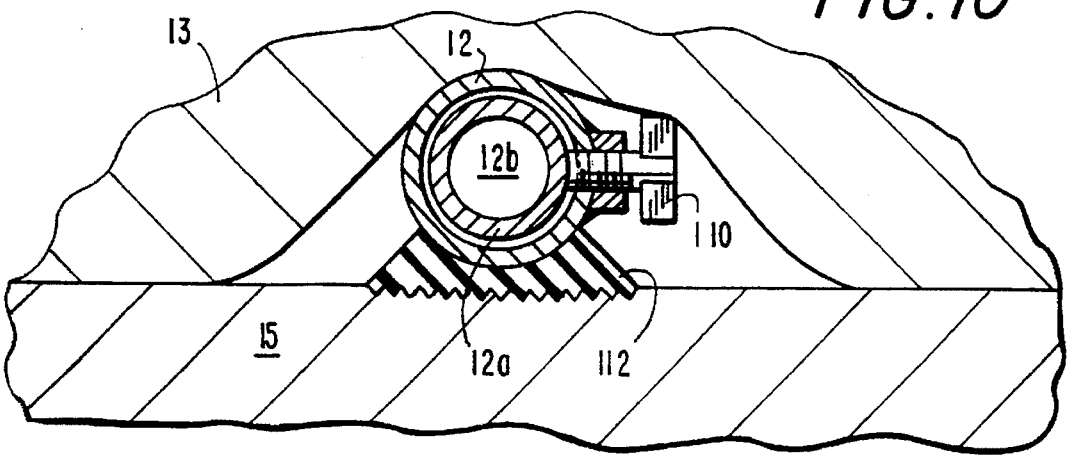

SAFETY RAIL FOR SLEEPING BEDS

This invention relates to sleeping beds, and in particular, a safety accessory for attachment to a sleeping bed for preventing the occupant from falling out.

The intended user is a small child or adult who is at risk of falling out of bed. The stated invention would be ideal in nursing homes or for beds for the mentally incompetent to prevent patients from falling off the bed. More commonly, however, the invention would be ideal to prevent young children from falling out of bed.

BACKGROUND

The use of bed rails has long protected the occupant of a bed from leaving or falling out of the bed, thus preventing injury. In the past, such devices have often consisted of two separate, parallel guard rails or side panels that are affixed parallel to the direction the bed. Hereinafter, the direction of the bed is defined as the direction from the head of the bed (where the occupant normally places his or her head), to the foot of the bed (where the occupant's feet rest). The two guard rails are each typically affixed to foot members that are designed to be inserted under a side edge of the bed mattress or sleeping surface. The foot members are typically inserted between a box spring and mattress, although they may be, alternatively, clamped to the bed frame, or bolted to other rigid members of the bed. Often, the foot members (which are spaced-apart in a direction parallel to the direction of the bed and which extend perpendicular to the direction of the bed) have had rubberized, relatively high surface friction ends, which are intended to develop friction between the mattress and/or box spring. In that manner, the foot members are intended to serve as anchors to keep the side guard rails firmly in place. Although the intent of such friction enhancement devices is to inhibit slippage of the foot members as against the bed parts (mattress, box spring, and the like), their advantages are negligible. In fact, the friction enhancement devices, for example, rubberized or ribbed bearing feet, are not adequate to keep the feet from becoming dislodged from the interface between the mattress and box spring. When the feet become so dislodged, they can slide out from between the mattress and box spring, and in turn, the side panels or guard rails pull away from the surface (for example, the sleeping surface) of the bed. When the side panels pull away from the sleeping surface, the occupant can fall out of bed, or even worse, can become wedged between the side panel and the bed itself—which can lead to severe injury or even death due to strangulation or from the fall.

Devices that rely on such foot members are therefore objectionable because they frequently fall out when pressure is applied to the side panels, for example, when a child rolls into the side panels during the night.

In addition, fixed rail systems that use clamps or bolts are cumbersome, and inhibit the making of beds, are difficult to install, and are unsightly. A need exists for a simple and compact bed rail which is more secure than that which is common with the prior art, with minimal possibility of accidental removal.

SUMMARY OF THE INVENTION

The conceived invention is that of a one-piece guard rail unit that may be instantly applied to or removed from a bed without the use of tools. Ideally, the conceived invention would in no manner be mechanically attached to the bed, and would not have the above described foot members.

The construction of this invention is simple and inexpensive. The bed rail may be stored in a minimal space when not in use, and the bed may be used with or without the rail. This is especially useful with children who outgrow the need for a bed guard rail, at which point it would simply be removed and stored. The present invention may be even so small as to be stored under a bed, or even between a mattress and a box spring, when placed into its folded position.

The devices embodying this invention are suitable for mail order distribution, as they may be packed and shipped in a minimum of space. The bed rail according to the present invention is also suitable for large-scale consumer distribution, such as in chain department stores.

According to one alternative feature of one embodiment of the present invention, four modes of deployment are contemplated. The modes of deployment are made possible because the guard rail unit is collapsible.

The first mode of deployment is essentially an undeployed mode, where the guard rail unit of the present invention is folded up in its stored position. The unit may be stored, for example, under a bed, in a box, or even between the mattress and box spring. Essentially, all members of the bed rail unit would be folded in parallel, to minimize storage space. The second mode of deployment is with one guard rail on one side of a bed deployed, while the other side of the unit (either a second guard rail or a retaining member) is folded downward, to anchor the unit. This mode of deployment is particularly well-suited for beds that are placed against a wall, where the wall will serve the purpose of the second guard rail. The third mode of deployment is with two guard rails deployed upward. This mode is particularly well-suited for the situation where the bed is not placed with either of its two sides against a wall. In that case, a guard rail is desired to be deployed along each side of the bed. And if desired, even in the event where two guard rails are deployed in an upward position, it may be desired to have downwardly protruding supplemental retaining members which will serve to secure the overall bed rail unit. Finally, in a fourth mode of deployment, both sides of the bed rail unit are folded downward—but not in their collapsed or stored position—as in the first mode of deployment. In that manner, the unit of the present invention can be readied for deployment—but is not folded away. To facilitate the fourth mode of deployment, the present invention should be designed with low profile members, so that when both side guard rails are folded downward, they are close to the sides of the bed, and allow the bed to be made without showing any conspicuous bulges or deformations in the appearance if the bed, which should be aesthetically pleasing.

According to an alternative embodiment of the present invention, the transverse members (the members that hold the side guard rails in place, that run perpendicular to the direction of the bed, under the mattress and preferably over the box spring), are telescoping and locking, so that beds of various widths can be accommodated. In this manner, the transverse members are deployed in a direction perpendicular to the direction of the bed, while the side guard rails snap and lock in an upward position (or into any position corresponding to any of the four modes of deployment). Thus, one or both side guard rails can be deployed upward, so that a bed occupant is cradled within the bed, while one side may be deployed upward, and the other downward, for example, when the bed is located contiguous to a wall, where only one side rail is required.

According to a feature of an alternative embodiment of the present invention, two side guard rails can be of a length and shape so that at any instant, at least one portion of a side guard rail or side guard member is deployed downward, to grip the box spring. That is, if only one side rail is desired to be deployed, then, ideally, at a minimum, the present invention should form a block letter "S"—whereby one leg of the "S" is the upwardly deployed side panel; the middle leg of the "S" are the transverse members that are impinged between the mattress and box spring (or floor and mattress, etc.); and the third and final leg of the "S" is deployed in the downward position, so that the overall bed rail system according to the present invention grips onto the mattress/box spring assembly, so that the upwardly deployed side rail cannot slide out when a child rolls against it. This corresponds to the second mode of deployment.

According to another feature of the present invention, an "H" configuration can be formed when it is desired to deploy both side panels in the upward position—whereby the center of the "H" is the transverse unit, while the outer legs extend from above the mattress (as the side panels), and the bottoms of the outer legs form the retaining members (impinged against the box spring, for example). This corresponds to the third mode of deployment. Of course, the bottom legs of the "H" can be eliminated, so that a "U" can be formed without downwardly deployed retaining members. Indeed, the weight of a bed occupant upon a mattress may effectively serve to secure the transverse members between the mattress and the box spring—obviating the need for the downwardly protruding retaining members.

According to another feature of the present invention, the transverse members can be equipped with high friction material, such as rubberized grommets. In this manner, the overall bed rail system will be more firmly stabilized between the mattress and box spring.

According to another feature of the present invention, the side guard panels can be fitted with various utility apparatus, including toys for children, electronic gear (tape, disc players, sleeping surveillance or monitors, pressure sensors, etc.), or any other equipment desired to be collocated with the bed. Also, the side panels may be padded, and ancillary equipment recessed, so that the side panel will be safe for bed occupants. Such side panels may be replaceable, so that a simple side panel can be replaced with a deluxe unit, which may possess additional features, such as an infrared camera (night vision) so that parents can monitor their children while they sleep. Indeed, an infrared or multimodal imaging unit may be added to the present invention, so that medical diagnostics can be performed while a bed occupant is resting. For example, by using infrared sensors, the breathing function of bed occupants can be monitored.

According to another feature of the present invention, the "H" (or "U") or "S" configurations may be formed from identical apparatus, so that one unit can be locked into either an "S" or an "H" (or "U"), with the median members forming the transverse assembly for insertion between the mattress and box spring, while the other members provide for side guard rails, and downwardly deployed members serve as retaining members (if desired).

According to another feature of the present invention, telescoping members and locks may be used to expand the invention to any size (or proportion), for various sizes of beds, or for shipping, via, for example, UPS.

BRIEF DESCRIPTION OF THE DRAWINGS

The invention will be described with respect to the drawings illustrating certain preferred embodiments, wherein:

FIG. 3 is a front head or foot view of the safety bed rail employed in the embodiment of FIG. 1, which shows the present invention deployed into a "both sides down" configuration;

FIG. 4 is a front head or foot view of the safety bed rail employed in the embodiment of FIG. 1, which shows the present invention undeployed, or totally folded, for storage, between the box spring and mattress of a bed;

FIG. 5 is a front head or foot view of the safety bed rail which shows the present invention deployed into an "H" configuration, with optional downwardly extending retaining members, and optionally, two side, upwardly extending guard rails;

FIG. 6 is an expanded perspective view of a collapsible and slidable/removable side panel or guard rail, shown with a mesh wall;

FIG. 7 is an expanded perspective view of a corner of a side panel according to the present invention, showing an attachment or accessory that can be optionally added to a side panel;

FIG. 8 is an exploded view of a portion of a side panel, showing a cassette tape player embedded within cavity affixed to or built into the side panel;

FIG. 9 is a schematic diagram of a side panel and its attachment pegs or struts, which are affixed to the transverse members which typically run perpendicular to the direction of the bed;

FIG. 10 is a detailed schematic diagram showing the transverse member inserted between the mattress and the box spring, with rubberized, and/or ribbed, friction-enhancement attachments.

DETAILED DESCRIPTION OF THE PREFERRED EMBODIMENT

Figure 1:
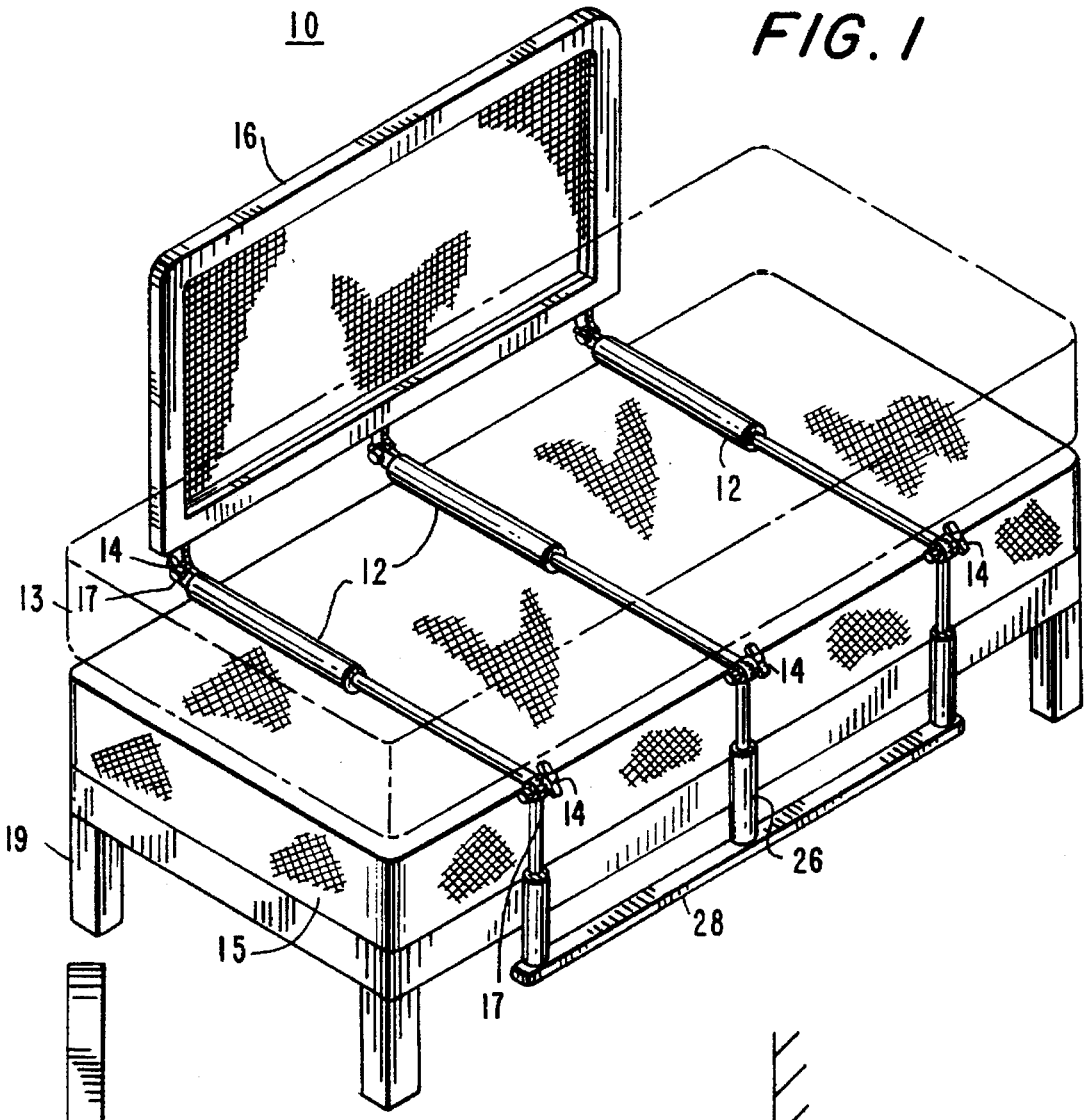
FIG. 1 is a perspective view of the safety bed rail which has been applied to the bed or crib in accordance with the present invention.

Referring to FIG. 1, a bed rail unit 10 in accordance with the present invention comprises three telescoping tubes or transverse members 12 to be placed above the box spring 15 and below the mattress 13. In order to adjust the bed side or guard rail 16, wing nuts 14 fasten the side panels 16 to the telescoping transverse tubes 12. The telescoping transverse members 12 can be placed into position to accommodate any size or shape of bed 19, mattress 13, or box spring 15, apart or in combination.

The side panel 16 extends a substantial length of the mattress 13 and moves between the safety upright position, a position in which it can be folded under the mattress 13 and above the box spring 15, preferably, in a downward, undeployed position. It is preferable to place side panel 16 in a downward position when undeployed because if it is placed in between the mattress 13 and box spring 15, the bed must be taken apart (at least partially) to deploy the guard rails 16, every time they are desired to be used. Hinge 17 allows for the movement of side panel 16 between upright and other positions.

Figure 2:
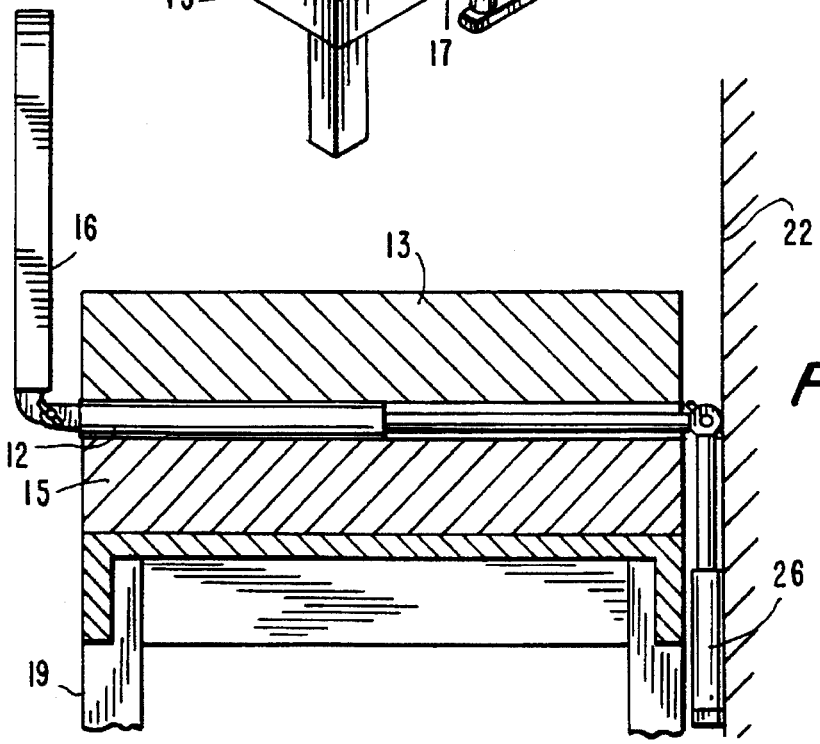
FIG. 2 is a front head or foot view of the safety bed rail employed in the embodiment of FIG. 1, which shows the present invention deployed into an "S" configuration.

With reference to FIGS. 1 and 2, since each of the hinge members 17 is identical, only one such hinge will be described in detail. The side panel 16 provides the means of securing the individual into the bed or crib. The hinges 17 are locked into a single position by wing nuts 14. In FIGS.

1 & 2, the invention is shown deployed in an "S" configuration, whereby the side panel 16 is deployed in an upright position. In that deployment mode, an occupant on the surface of mattress 13 cannot roll out of the bed inadvertently. The "S" configuration is particularly well-suited when bed 19 is located adjacent to a wall 22. In that manner, retaining member 26 with its stabilizer bar 28 (which can interconnect a plurality of retaining members 26 with a plurality of transverse members 12) is deployed downward, so that the bed rail unit 10 of the present invention is firmly anchored between the mattress 13 and box spring 15. Of course, stabilizer bars 28 are optional, but can prevent the transverse members 12 from becoming bent or otherwise damaged. Naturally, stabilizer bars 28 help to provide for a rigid structure. Notably, bed 19 can be any size (length or width), because transverse members 12 are telescoping (and locking, whereby the locks are incorporated into the telescoping member, which are not shown but well-known in the art), so that any width of bed can be accommodated. Also, the side panel 16 can be extended in length, to accommodate longer beds. For example, telescoping members as shown in FIG. 6 can be used. Also, the bed rail unit 10 can be collapsible and foldable, due to the use of hinges 17 and wing nuts or locking mechanisms 14. Importantly, any flexible joint can be substituted for such hinges, and any locking mechanism can be used. Indeed, the wing nut, while functional, is not aesthetically pleasing, and can be caught on sheets or even worse, caught on the limbs of bed occupants, causing injury. Preferably, in the alternative, a locking pressure fitting or collar can be used to retain members in fixed positions. Also, preferably, all parts will conform to safety standards adopted for children and infants. Also, preferably, all parts will be formed of high-impact, resilient plastic, suitably textured.

FIG. 2 shows the bed rail unit 10 as it would be used when placed against a wall 22. One of the panels 16 would be up to contain the occupant, while the other member, a retaining member 26 as shown, would be deployed downward. Alternatively, retaining member 26 may be telescoping (as shown in FIGS. 1 & 2) with the stabilizer bar 28 (as shown in FIG. 1). Alternatively, retaining members 26 may be replaced with another side panel 16 (as shown in FIG. 5). In that case, the side panel 16 may serve the dual purposes of both retaining member for anchoring the bed rail unit 10 within the bed 19, or acting as a side panel to keep the occupant in the bed (on the surface of the mattress 13).

FIG. 3 illustrates both of the side panels 16 down (or a side panel 16 and retaining member 26 deployed in the downward direction). This configuration would be useful when making the bed 19, and for providing ready access to a young child when desired. With reference to FIG. 3, since each of the telescoping tubes 12 are identical, only one will be described in detail. The tube 12 is placed between box spring 15 and mattress 13. Attached to the bottom of the tube 12, optionally, are friction enhancement or gripping surfaces 112 (shown in FIG. 10) to prevent the bed rail unit 10, and more particularly, the side panel 16, from slipping out and becoming dislodged. As shown in FIG. 3, both sides are deployed downward, so that the bed rail unit 10 is out-of-service, but ready to be deployed at a moments notice. By way of example, side panel 16 can be pulled upward, by loosening wing nut or lock 14, so that the side panel 16 swings upward about hinge or axis 17. Once in position, side panel 16 can be locked into place by activating lock 14. Lock 14 may preferably be a plastic pressure fitting, or can be a ratchet/lock combination, a wing nut disposed over toothed surfaces, or any locking mechanism, well-known in the art, which is effective, durable and safe (without jagged edges).

FIG. 4 illustrates possible storage of the bed rail 10. When the bed rail 10 is not being used both side panels 16 can be either deactivated but ready for use (as shown in FIG. 3), or totally folded under the mattress 13 (as shown in FIG. 4), thus using very little space. As shown in FIG. 4, the unit 10 is stored between the box spring 15 and the mattress 13, and in this stored position, the bed rail unit 10 requires a minimum of space. Again, the locks 14 can be used to keep the unit 10 folded and locked, much the same way a tire jack stows away in its locked condition in some newer automobiles.

FIG. 5 shows the bed rail 10 as it would be used in a free standing situation (in either an "H" or "U" configuration). In this embodiment, two side rails 16 are used, and the retaining members 26 and stabilizing members 28 as shown in FIGS. 1 & 2 are obviated. Both side panels 16 would be deployed in the upward position, so as to contain the occupant on both sides. It may be desirable to attach supplemental retaining members 52 to the unit 10, so as to stabilize and anchor the unit 10 to the bed. That is, in the "H" configuration shown in FIG. 5, supplemental retaining members 52 may be deployed downward, so as to anchor the unit 10. Such supplemental retaining members 52 may be telescoping and locking if desired. Alternatively, transverse members 12 may be coated with friction enhancement materials 112 (shown in FIG. 10), to minimize or eliminate the need for retaining members 52. Furthermore, supplemental retaining members 52 may be eliminated entirely, if it is believed that the weight of the bed occupant will sufficiently anchor the bed rail unit 10 to the bed, that is, that the transverse members 12 will be tightly retained by the mattress 13, box spring 15, etc. Importantly, supplemental retaining members 52 can be of any length desired (even short in comparison to the height of side panels 16), and can be collapsible, for storage, or for when they are not required (as is the case when the unit is in the "S" configuration, shown in FIGS. 1 & 2). That is, even an "H"/"U" bed rail unit 10 according to the present invention can be formed into an "S" configuration, whereby a side guard rail 16 serves the function of the retaining members 26 (with stabilizer members 28) or supplemental retaining members 52. Finally, lock 14 and hinge 17 can also be used to adjust and control the position of optional supplemental retaining members 52, as well as the side guard rails 16 or retaining members 26.

FIG. 6 illustrates the assembly of the side panel or guard rail 16 to the internal panel pegs 68. The side panel 16 could be encapsulated by a thick cushion-like material so that if the occupant were to make contact with the side panel 16, such impact would be dampened, thereby preventing any harm to the occupant. Also, any covering used upon side panel 16 should preferably be non-toxic and flame resistant, for safety concerns. There would be many varieties of material to chose from to accommodate a wide variety of consumer preferences. In FIG. 6, a mesh or screen 66 is used to form the walls of side guard rail 16. In that manner, if the face of a bed occupant is placed against the side rail 16, air passages will not be interrupted, and air may pass freely into and out of the subject. Telescoping members 62 (which can be locking—not shown, but well-known in the art), can be used to extend the length of the side panel 16, wherein the mesh unit 66 recoils into a central roll 67. End retention members 64 hold the mesh 66 securely, and also attach the mesh 66 to the transverse members 12. Also, end retention members 64 can be affixed to an removed from internal panel pegs 68. In that manner, alternative side panels can be formed. For example, the assembly of the retention members 64, mesh unit 66, and the like, can be of any form, for example, a single wooden panel, a foam padded plastic panel, etc. Optionally, a locking mechanism 69, which can be any locking mechanism, or simply, a spring-loaded detent type button/hole combination, may be used to snap alternative side panels into place.

Also, alternatively, internal pegs 68 (shown in FIGS. 5 and 6) may be, in fact, external. In that alternative, peg 68 would serve as a retaining member against mattress 15. Ideally, peg 68 (as an external peg) would be of a length of less than the height of the mattress 15, so that peg 68 could retain the overall assembly of the present invention on the bed, while the weight of the bed occupant lies upon the bed. As an external peg, peg 68 would preferably be constructed of a smooth plastic or foam rubber, so that bed occupants would not cut themselves against it. For example, when the bed is placed against a wall, a side panel 16 could keep the occupant from rolling out, while the external peg 68 is disposed between the bed and a wall 22. Naturally, peg 68 locking mechanism 69 can be used to interchange the side panel assemblies, allowing for the upgrading of side panels. For example, as children grow older, alternative side panels 16 can be replaced with other more mature panels (that is, for example, an infant's "busy box" can give way to a radio, which can give way to a compact disc player). As shown in FIG. 6, the entire side panel assembly can be lifted off of the pegs 68. Of course, snap on caps (that is, hollow tube end caps) may be inserted upon pegs 68, to provide for enhanced safety and greater aesthetic quality.

In FIG. 7, any choice of gadgets 72 could be attached to or embedded within a side panel 16. These would include, but would not be limited to, a cassette/radio/disc player, an alarm that would sense pressure upon the side panel 16, and an audio/visual baby monitor. The monitor would use an infrared sensor to operate without light, and operate on a closed circuit system in which a parent or guardian could supervise bed occupants from another room on their television, for example.

In FIG. 8, a cassette player 82 is shown embedded within side panel 16, wherein side panel 16 is shown affixed to an encapsulated retainer 84 which could be a thick panel of foam, used to attach the cassette player 82 to the side rail 16.

In FIG. 9, an alternative embodiment of the side panel 16 assembly is shown, with the pegs 68 (shown in FIG. 6) replaced with dowel rods 92 and securing means (for example, screws) 94. In that manner, dowel rods 92 can be affixed to transverse members 12 by way of hinges 17, which can be ratchets with locks, or any other desired arrangement. In effect, a "cuff-link" apparatus is formed, whereby the side rail 16 can be removed so that transverse members 12 with pegs/dowels 92 can be slid under the mattress 13 and over box spring 15—or between any other sandwiched bedding arrangement. That is, by using a "cuff-link" apparatus, members 92 can be tilted (that is, moved to be in parallel with the transverse members 12) so that they can be slid under a mattress 13; then pulled open to become perpendicular to the transverse members 12 as shown in FIG. 9; and then the side panel 16 can be slipped onto the dowels 92 and secured by locks 94. Naturally, so that the present invention may be easily cartoned and shipped, it may be disassembled in any number of ways, for example, by having two (2) "T" assemblies, that snap onto the transverse members 12, so that pegs 68 may be used to keep the present invention in place.

In FIG. 10, a detailed view of the telescoping transverse members is shown, where telescope 12 has an outer wall **12*a* and an inner member 12*b*. Lock 110 is used to lock the telescope 12 into a fixed position as desired, while friction enhancement mechanism 112—as shown, a ribbed member, which may be formed of high friction rubber, etc., is to help hold the transverse member 12 securely between the mattress 13 and box spring 17. Importantly, the overall dimensions of members 12 must be minimized, to eliminate any bulges that could result between the mattress 13 and box spring 17** (which could disturb the;restful sleep of the bed occupant).

With respect to the present invention, any number of additional transverse or longitudinal members may be added to provide additional stability, and to enhance the structural integrity of the overall assembly. Also, any number of locks, pressure collars, springloaded detent type snaps, and the like, may be added to provide for easy assembly and enhanced portability. While the foregoing embodiments of the invention have been set forth in considerable detail for the purposes of making a complete disclosure of the invention, it will be apparent to those of skill in the art that numerous changes may be made in such details without departing from the spirit and the principles of the invention.

What is claimed is:

1. A bed safety system comprising:

a telescoping transverse member for removable positioning between a mattress and a boxspring;

a first vertical member for protruding at least partially vertically beyond the perimeter of said mattress;

a second vertical member for protruding at least partially vertically beyond the perimeter of said mattress; and wherein said first and second vertical members are rotatable around 180 degrees and are connected to said transverse member by way of a lockable and pivoting apparatus.

2. A bed safety system according to claim 1, further comprising a side panel attached to one or both of said first and second vertical members for retaining an occupant in bed.

3. A bed safety system according to claim 2, wherein said side panel is constructed of a porous material.

4. A device according to claim 3, wherein said porous material is mesh.

5. A device according to claim 3, wherein said porous material is a screen.

6. A device according to claim 3, wherein said porous material is a grill.

7. A bed safety system according to claim 2, wherein said side panel is constructed of a foam material.

8. A bed safety system according to claim 2, wherein said side panel includes an entertainment device.

9. A bed safety system according to claim 2, wherein said side panel includes a monitoring device.

10. A bed safety system according to claim 9, wherein said monitoring device is electronically interfaced to a television monitor.

11. A device according to claim 1, wherein at least one member is formed of wood.

12. A device according to claim 1, wherein at least one member is formed of plastic.

13. A device according to claim 1, wherein at least one member is formed of metal.

* * * * *